US007441420B2

(12) United States Patent
Kim et al.

(10) Patent No.: US 7,441,420 B2
(45) Date of Patent: Oct. 28, 2008

(54) DEVICE FOR FASTENING TUB TO MOVE DRUM TYPE WASHING MACHINE

(75) Inventors: Jea-Kyum Kim, Kimhae-shi (KR); Ho-Cheol Kwon, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/433,159

(22) PCT Filed: Nov. 27, 2001

(86) PCT No.: PCT/KR01/02049

§ 371 (c)(1),
(2), (4) Date: May 30, 2003

(87) PCT Pub. No.: WO02/44458

PCT Pub. Date: Jun. 6, 2002

(65) Prior Publication Data

US 2004/0037640 A1 Feb. 26, 2004

(30) Foreign Application Priority Data

Dec. 1, 2000 (KR) ..... 2000-72372

(51) Int. Cl.
*B08B 3/12* (2006.01)

(52) U.S. Cl. ..... 68/3 R; 68/212

(58) Field of Classification Search ..... 403/24, 403/167, 168, 187, 192, 194, 197, 201, 230, 403/233, 240, 247, 256–261, 388, 389, 396, 403/408.1; 63/3 R; 68/3 R, 212; 206/320
See application file for complete search history.

(56) References Cited

FOREIGN PATENT DOCUMENTS

| | | | | |
|---|---|---|---|---|
| DE | 79 29 807 | U1 | | 1/1980 |
| DE | 3739036 | A1 | * | 5/1989 |
| DE | 4238686 | C1 | * | 3/1994 |
| DE | 4238685 | A1 | * | 5/1994 |
| DE | 195 25 316 | A1 | | 1/1997 |
| DE | 19703396 | C1 | * | 11/1997 |
| DE | 196 51 292 | A1 | | 6/1998 |
| DE | 29820224 | U1 | * | 2/2000 |
| EP | 319081 | A1 | * | 6/1989 |
| GB | 2 043 707 | A | | 10/1980 |
| GB | 2043707 | A | * | 10/1980 |
| JP | S48-15650 | | | 5/1973 |
| JP | 55094749 | | | 7/1980 |
| JP | S59-142504 | | | 9/1984 |
| JP | S60-88107 | | | 6/1985 |
| JP | 04-288198 | | | 10/1992 |
| KR | 10-1994-0011912 | | | 12/1994 |
| KR | 1999-0012987 | | | 4/1999 |
| KR | 2001047782 | A | * | 6/2001 |
| WO | WO 86/06448 | | | 11/1986 |

* cited by examiner

*Primary Examiner*—Victor MacArthur
(74) *Attorney, Agent, or Firm*—McKenna, Long & Aldridge LLP

(57) ABSTRACT

A device for fastening a tub to move a drum type washing machine is disclosed, in which a main body of a fastening bolt having no thread is located in an inlet of a fastening boss formed in a tub so that the intensity of the fastening bolt is improved. Thus, the fastening bolt can bear stress generated by vibration of the tub and external impact when the drum type washing machine moves.

10 Claims, 4 Drawing Sheets

DEVICE FOR FASTENING TUB TO MOVE DRUM TYPE WASHING MACHINE

TECHNICAL FIELD

The present invention relates to a drum washing machine, and more particularly, to a device for fastening a tub to move a drum type washing machine, in which a tub is fastened to a body during transportation of the drum washing machine for preventing the tub supported from the body by springs from shaking.

BACKGROUND ART

In general, the washing machine is an appliance which removes dirt stuck to laundry by chemical decomposition and mechanical impact. As not only a total height of the appliance can be reduced compared to the pulsator washing machine of which inner tub rotates in a vertical position, but also a washing capacity can be increased more, and causes almost no problems, such as entangling of laundry, demand for the drum type washing machine increases day by day.

A related art structure of a drum washing machine will be explained, with reference to the attached drawing in detail. FIG. 1 illustrates a section of a related art drum washing machine, provided with a tub 2 supported by dampers 8 and springs 7 in a body 1, a cylindrical drum 3 rotatably fitted in the tub, and a driving part shaft coupled to the drum.

The driving part is provided with a rotor 4 and a stator 5 in rear of the tub 2, wherein the rotor 4 is directly coupled with a washing shaft 6 fitted to be rotatable with the drum for transmission of a driving force of the rotor to the drum 3 directly without a pulley or belt. There are a door 9 in a front face of the body opposite to an opening of the drum, and a gasket 10 between the door and the drum for sealing. In the foregoing drum washing machine, the rotation force of the rotor 4 is transmitted to the drum 3 through the washing shaft 6, and the washing is progressed as the laundry is lifted by a baffle 3*a* and dropped by gravity during rotation of the drum.

In the meantime, when the drum washing machine is transported, the tub 2 is shaken in up and down, and left and right directions because the tub 2 is supported by the springs 7 and the dampers 8, giving impacts to the driving part under the tub 2 or damage to the body 1. In order to prevent this, a device for fastening the tub 2 to the body in transportation is provided, which has a plurality of fastening bosses 11 on a rear surface of the tub and a plurality of fastening bolts 12 for passing through inserting holes in the body and coupled to the fastening bosses.

FIG. 2 illustrates a section of a key part of a related art fastening device for transportation of a drum washing machine, showing an enlarged view of the fastening bolt fastened to the fastening boss.

Referring to FIG. 2, since the fastening bolt 12 has an appropriate length of male thread part 12*a* on an outer circumference of an end thereof, and the fastening boss 11 has a female thread part 11*a* in an inner circumference thereof for engagement with the male thread part 12*a*, the fastening bolt and the fastening boss are fastened as the male thread part 12*a* and the female thread part 11*a* are engaged.

When the fastening bolt 12 is fastened to the fastening boss 11, a bolt holder 13, surrounding an outer circumference of the fastening bolt, protects the fastening bolt and maintains a gap between the tub and the body.

The impact occurred during transportation of the drum washing machine applies vibration to the tub 2, or to the fastening bolt 12 and the fastening boss 11, directly. In this instance, the vibration of the tub 2 acts as a bending moment or a shearing force to the fastening bolts 12 at a part the fastening boss 11 is in contact with the bolt holder 13. However, since the male thread part 12*a* on the fastening bolt 12 is exposed to outside of the fastening boss 11, there has been a problem in that the fastening bolt 12 becomes weak to strength.

That is, because the male thread part 12*a* on the fastening bolt is exposed outside of the fastening boss 11 in a state the fastening bolt 12 is engaged with the fastening boss 11 in the related art, there has been a stress concentration at a root part of the male thread part 12*a* in a part the fastening boss 11 is in contact with the bolt holder 13 due to the vibration or impact occurred during transportation of the drum washing machine, to cause bending in the root part of the male thread part 12*a* at which the stress is concentrated, with a high risk of breakage when the impact is excessive.

In other words, the root part of the male thread part of the fastening bolt at a point the fastening boss 11 and the bolt holder 13 are in contact acts as a notch that causes stress concentration, to weaken a strength of the fastening bolt against an impact to the tub.

Consequently, for solving the foregoing problem, it has been required to employ a thick fastening bolt with an adequate root diameter, or to provide a separate protection device.

DISCLOSURE OF INVENTION

The object of the present invention devised for solving the foregoing problem lies on providing a device for fastening a tub to move a drum type washing machine which fastens a tub supported by springs during transportation of the drum washing machine for preventing damage or deformation caused by an external impact or vibration of the tub, particularly, by using fastening bolts and fastening bosses each with the present male thread part and female thread part, respectively.

For achieving the foregoing object, the present invention provides a device for fastening a tub to move a drum type washing machine having a tub for storing washing water, a drum rotatably fitted to the tub, a motor for rotating the drum, and a main body enclosing an outer shell of the tub, the device for fastening the tub to the main body during transportation of the drum washing machine includes a fastening bolt passed through the main body and fastened to the tub, and a fastening boss in rear of the tub for coupling with the fastening bolt, wherein the fastening bolt includes a head, a body extended from the head having no thread for insertion of a part thereof in the fastening boss, and a male thread extended from the body having male threads formed thereon, and the fastening boss includes a female thread having female threads formed therein to fit to the male thread on the fastening bolt, and an insertion hole at an entrance thereof for receiving a part of the body of the fastening bolt.

The body of the fastening bolt has an outside diameter greater than a root diameter of the male thread.

The insertion hole in the fastening boss has an inside diameter equal to or greater than an outside diameter of the female thread.

The fastening boss is formed as one unit with the tub.

The fastening device further includes a bolt holder on an outside of the fastening bolt fastened to the fastening boss to surround the outside circumference of the body of the fastening bolt, such that ends of the bolt holder and the fastening boss abut, and the point the bolt holder and the fastening boss abut is at a body region of the fastening bolt.

There is a rubber bushing in a form surrounding the bolt holder on an outside of a part passed through a body of the bolt holder, and there is a washer between the head of the fastening bolt and the rubber bushing.

BEST MODE FOR CARRYING OUT THE INVENTION

A device for fastening a tub to move a drum type washing machine in accordance with a preferred embodiment of the present invention will be explained, with reference to the attached drawings.

Figure 1:
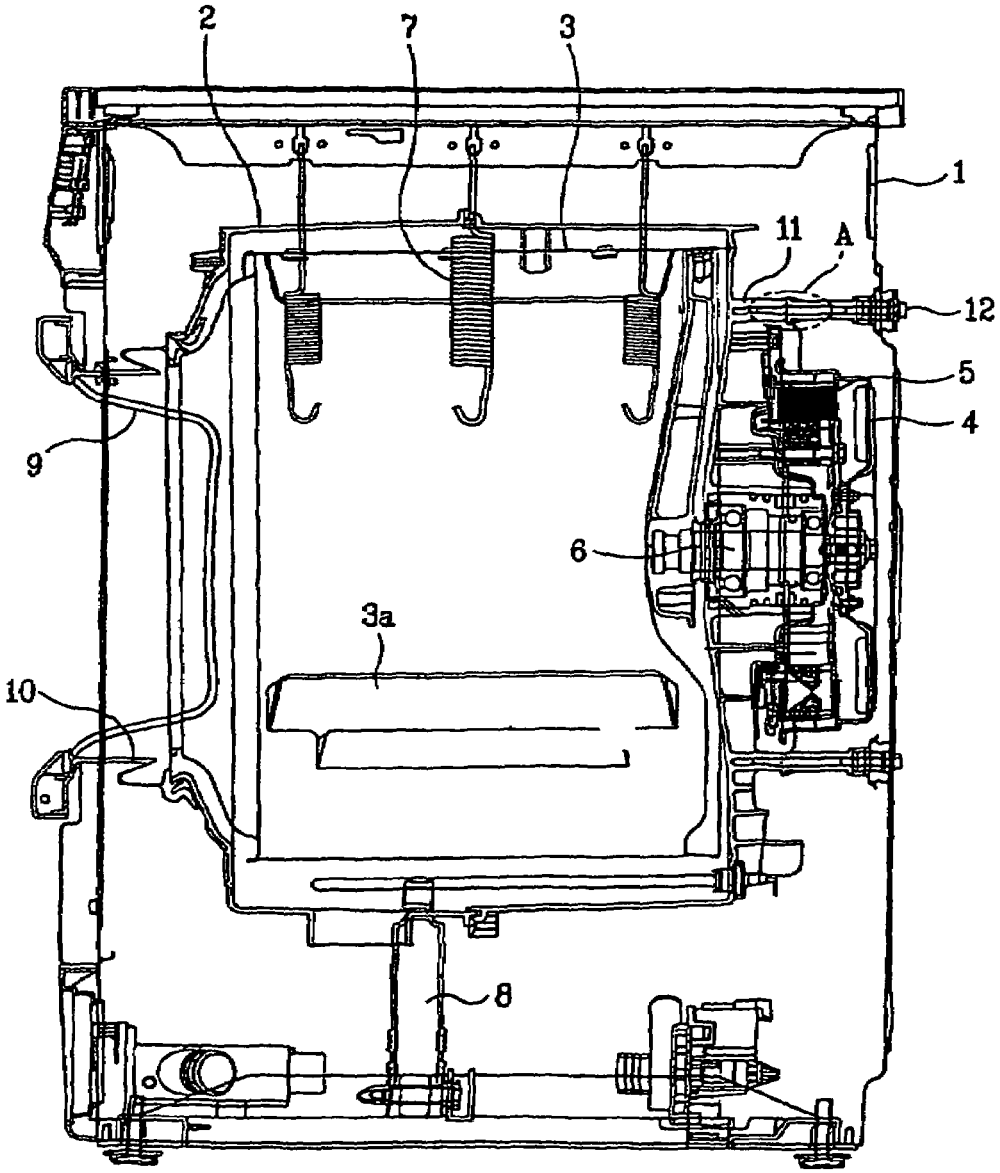
FIG.1 Prior Art
FIG. 1 illustrates a section of a related art drum washing machine.
Figure 2:
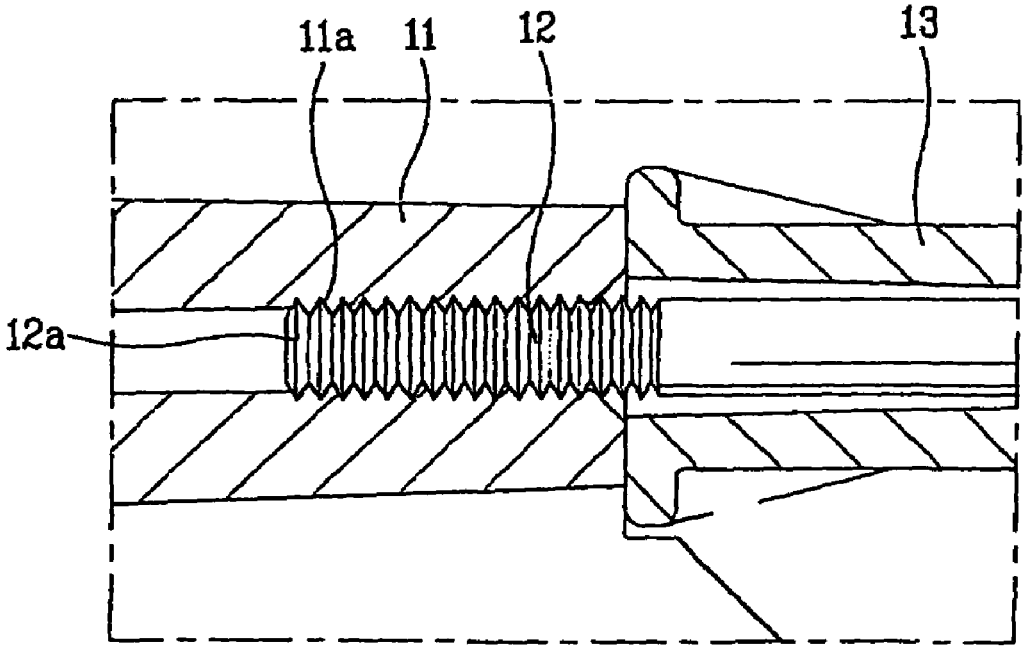
FIG.2 Prior Art
FIG. 2 illustrates a section of a key part of a related art device for fastening a tub to move a drum type washing machine.
Figure 3A:
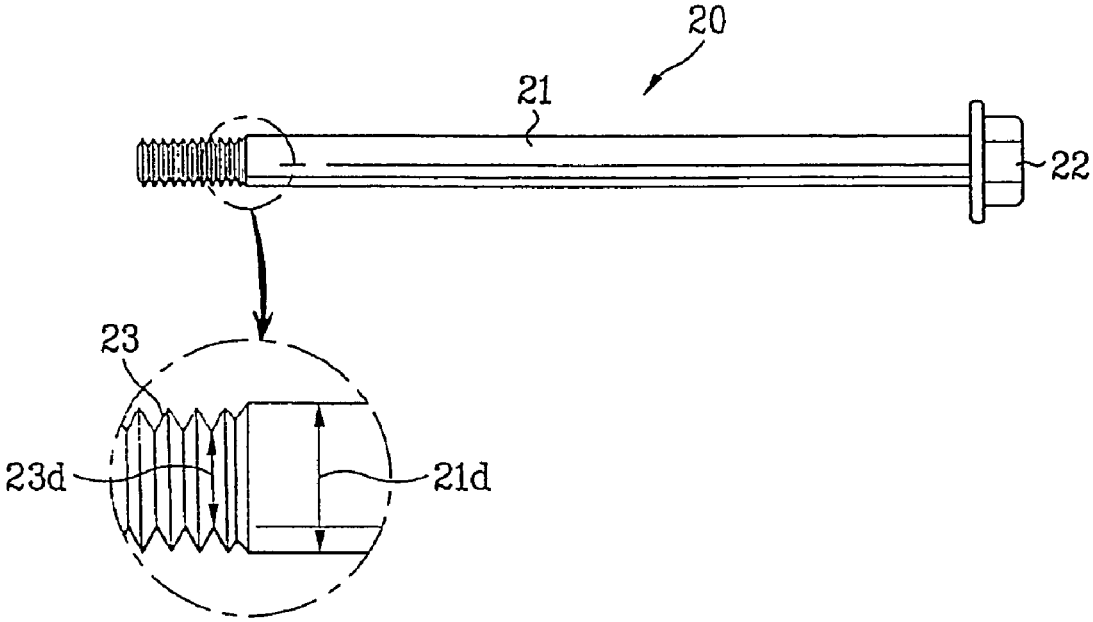
FIG. 3*a* illustrates a section of a fastening bolt of a drum washing machine in accordance with a preferred embodiment of the present invention.
Figure 3B:
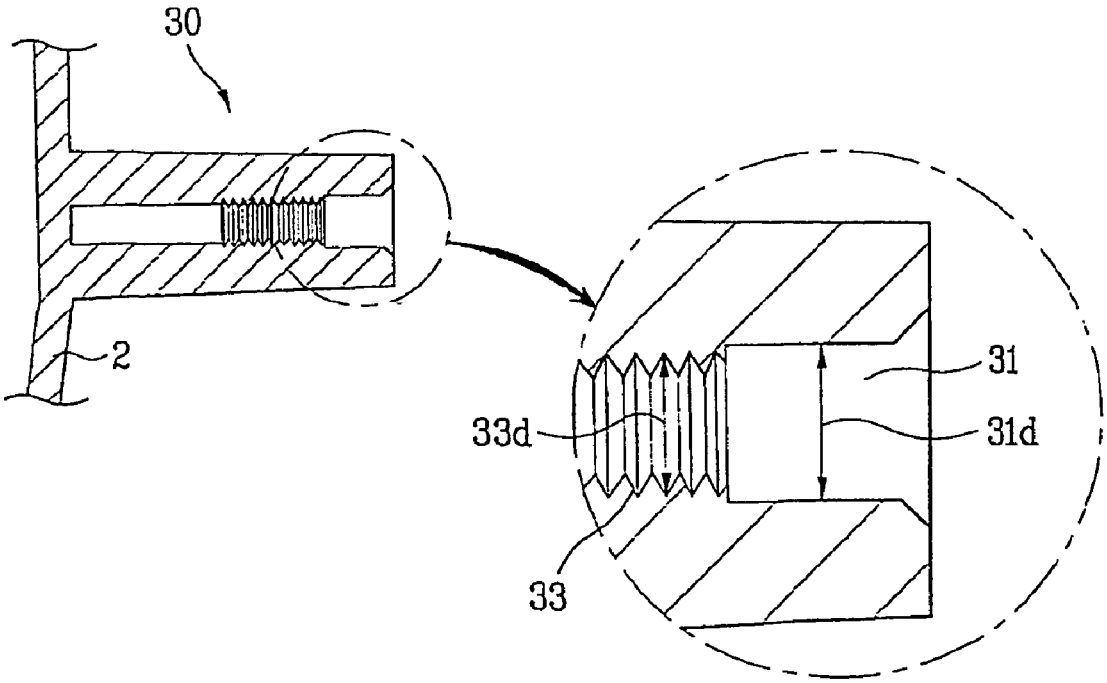
FIG. 3*b* illustrates a section of a fastening boss of a drum washing machine in accordance with a preferred embodiment of the present invention; and, FIG. 4 illustrates a section of a device for fastening a tub to move a drum type washing machine in accordance with a preferred embodiment of the present invention.
Figure 4:
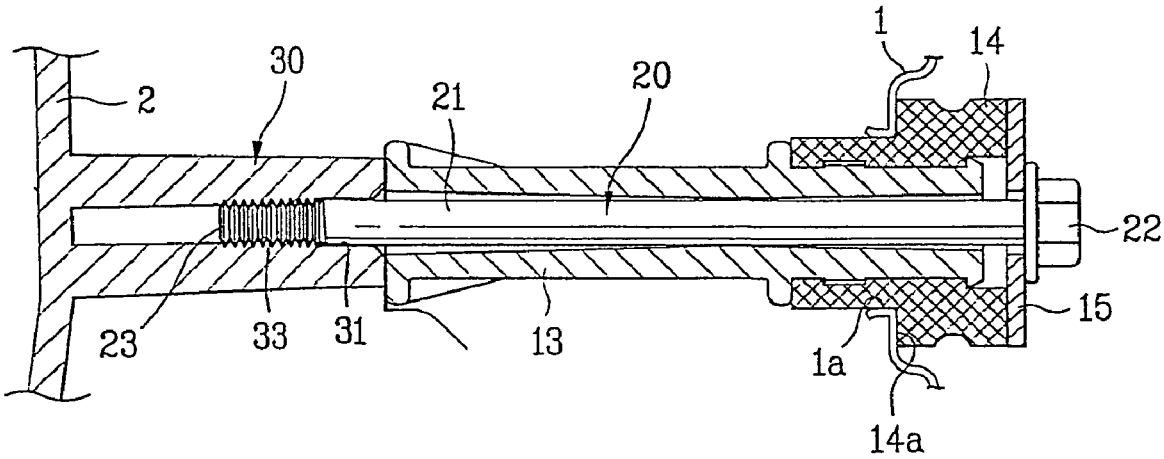

FIG. 3*a* illustrates a section of a fastening bolt of a drum washing machine in accordance with a preferred embodiment of the present invention, FIG. 3*b* illustrates a section of a fastening boss of a drum washing machine in accordance with a preferred embodiment of the present invention, and FIG. 4 illustrates a section of a device for fastening a tub to move a drum type washing machine in accordance with a preferred embodiment of the present invention.

Prior to starting explanation, parts related to a general drum washing machine system are the same with the previous description, of which explanation will be omitted, and explanation of the device for fastening a tub to move a drum type washing machine will be explained.

Referring to FIG. 3A, the fastening bolt 20 for transportation of a drum washing machine includes a body 21 with an outside diameter, a head 22 at one end of the body for being caught at a main body, and a male thread 23 at the other end of the body with a length. The outside diameter 21*d* of the body is greater than a root diameter 23*d* of the male thread 23.

In the meantime, referring to FIG. 3B, the fastening boss 30 of the drum washing machine in accordance with a preferred embodiment of the present invention is formed as one unit with the tub 2, and projected from rear of the tub 2 at a length toward the main body 1.

The fastening boss 30 has a female thread 33 in the middle of a length thereof for fitting to the male thread 23 of the fastening bolt 20, and an insertion hole 31 from one end of the female thread to an entrance for receiving a part of the body 21 of the fastening bolt when the fastening bolt 20 is coupled to the fastening boss 20. No thread is formed in an inside circumference of the insertion hole 31. The insertion hole has an inside diameter 31*d* at least equal to, or greater than an outside diameter 33*d* of the female thread 33 for insertion of the body of the fastening bolt.

Coupling of the foregoing fastening bolt and the fastening boss will be explained, in more detail.

Referring to FIG. 4, a device for fastening a tub to move a drum type washing machine in accordance with a preferred embodiment of the present invention includes the fastening boss 30 and the fastening bolt 20, and, in addition to these, a bolt holder 13 fitted to surround an outside circumference of the body 21 of the fastening bolt for maintaining a gap between the main body 1 and the tub 2, a rubber bushing 14 fitted to surround one end of an outside circumference of the bolt holder and be inserted in the insertion hole 1*a* in the body for absorbing an impact, and a washer 15 fitted between the rubber bushing and the head 22 of the fastening bolt.

The foregoing fastening device is assembled as follows.

At first, the bolt holder 13 is inserted in, and coupled with, the rubber bushing 14 the washer 15 is inserted through the body 21 until being caught at the head 22, and the rubber bushing 14 and the bolt holder 13 are inserted in the body 21 of the fastening bolt.

In this instance, not only the male thread 23 on the fastening bolt, but also a length of the body 21 of the fastening bolt the same or greater than a length of the insertion hole in the fastening boss pass through an end of the bolt holder 13.

Then, the fastening bolt having the bolt holder and the rubber bushing fitted thereto is pushed into the insertion hole 1*a* in rear of the main body until a step 14*a* of the rubber bushing 14 is caught at a rim of the insertion hole of the main body, and turns until an end of the bolt holder 13 comes to contact with the entrance of the fastening boss 30, thereby coupling the fastening bolt to the fastening boss.

In this instance, the male thread 33 in the fastening boss is engaged with the male thread 23 on the fastening bolt, and a part of the body 21 of the fastening bolt is received at the insertion hole 31 in the fastening boss, thereby fastening the tub 2 to the main body 1 firmly.

Thus, different from the related art, the device for fastening a tub to move a drum type washing machine of the present invention positions the body 21 of the fastening bolt at a point the fastening boss 30 is in contact with the bolt holder 13, that has been a part susceptible to impact and vibration during transportation, permitting to endure a load caused by an external impact or vibration of the tub during transportation of the drum washing machine.

That is, because the male thread of the fastening bolt is exposed to outside of the fastening boss, though deformation or breakage is occurred from a root part exposed nearest to the point the fastening boss and the bolt holder are in contact once a bending moment or a shearing force caused by vibration of the tub is applied thereto in the related art, the fastening device of the present invention can endure the shearing force or the bending moment well because the body of the fastening bolt is positioned at the point.

INDUSTRIAL APPLICABILITY

The device for fastening a tub to move a drum type washing machine of the present invention employs a fastening bolt having a body, and a male thread at one end of the body, and a fastening boss having an insertion hole at an entrance for receiving a part of the body of the fastening bolt, and a female thread in an inside of the entrance for fitting to the male thread on the fastening bolt, for fastening the tub supported by springs and damper firmly during transportation.

Accordingly, a load from the tub is applied, not to the male thread, but to the body, the fastening bolt can endure impact and the like during transportation because no thread is formed on an outside circumference of the body, and an outside diameter of the body is greater than a root diameter of the male thread, that permit to secure an adequate strength.

At the end, different from the related art, the present invention permits to prevent the fastening bolt from being deformed or damaged by a load of the tub or impact during transportation even if a thick fastening bolt having adequate root diameter of the male thread is not used.

What is claimed is:

1. A washing machine comprising:

a drum rotatably fitted to a tub for storing washing water;

a main body enclosing an outer shell of the tub;

a motor operatively connected to the drum;

a fastening bolt including a head, a male threaded portion and a non-threaded portion, an outer diameter of the non-threaded portion being greater than a smallest diameter of the male threaded portion;

a bolt holder including first and second protrusions on an outer surface;

an elastic bushing surrounding the outer surface of the bolt holder, the bushing being fixed between a washer and the main body, and fixed between the washer and the first protrusion; and fixed between the first protrusion and second protrusion;

a fastening boss extending unitarily from a rear surface of the tub and having a female threaded portion that receives the male threaded portion of the bolt; and having a female non-threaded portion that receives the non-threaded portion of the fastening bolt;

wherein the fastening bolt passes through the washer, the bushing, the bolt holder and the main body to fix the tub relative to the main body.

2. The washing machine as claimed in claim 1, wherein an insertion hole in the fastening boss has an inside diameter equal to or greater than an outermost diameter of the female threaded portion.

3. The washing machine as claimed in claim 1, wherein the bolt holder, on an outside of the fastening bolt, surrounds the outside circumference of a body of the fastening bolt, and the fastening bolt fastens to the fastening boss such that ends of the bolt holder and the fastening boss abut at a body region of the fastening bolt.

4. The washing machine as claimed in claim 1, wherein the bolt holder is disposed between the washing machine body and the fastening boss.

5. The washing machine as claimed in claim 1, wherein the bolt holder is disposed about the fastening bolt between the head of the fastening bolt and the fastening boss.

6. The washing machine as claimed in claim 1, wherein a free end of the fastening boss is disposed around the non-threaded portion of the fastening bolt.

7. The washing machine as claimed in claim 1, wherein an end of the fastening boss facing the body of the washing machine is disposed around the non-threaded portion of the fastening bolt.

8. The washing machine as claimed in claim 1, wherein ends of the bolt holder are disposed around the non-threaded portion of the bolt.

9. The washing machine as claimed in claim 1, wherein the bolt holder abuts the fastening boss.

10. The washing machine as claimed in claim 9, wherein the portion of the bolt holder that abuts the fastening boss is disposed around the non-threaded portion of the fastening bolt.

* * * * *